United States Patent [19]

Burns

[11] Patent Number: 4,949,639

[45] Date of Patent: Aug. 21, 1990

[54] TEMPERATURE-COMPENSATED, ACCELERATION-ACTIVATED IGNITER

[75] Inventor: Bruce P. Burns, Churchville, Md.

[73] Assignee: The United States of America as represented by the Secretary of the Army, Washington, D.C.

[21] Appl. No.: 379,303

[22] Filed: Jul. 3, 1989

[51] Int. Cl.[5] ..... F42C 15/24

[52] U.S. Cl. ..... 102/249; 102/251; 102/352

[58] Field of Search ..... 102/352, 247, 248, 249, 102/251

[56] References Cited

U.S. PATENT DOCUMENTS

| | | | |
|---|---|---|---|
| 4,128,061 | 12/1978 | Kaiser | 102/249 |
| 4,144,816 | 3/1979 | Beuchat | 102/251 |
| 4,449,457 | 5/1984 | Halssig | 102/251 |
| 4,699,057 | 10/1987 | Ibarra | 102/248 |
| 4,716,830 | 1/1988 | Davis et al. | 102/248 |

*Primary Examiner*—Peter A. Nelson

*Attorney, Agent, or Firm*—Saul Elbaum; Paul S. Clohan

[57] ABSTRACT

A propellant igniter that is controlled by temperature and is activated by acceleration. The igniter includes a booster or primer for igniting a propellant charge. A spring-loaded firing pin is cocked by a rotating sear that, when released, energizes the booster. Rotation of the sear is controlled by a plurality of springs one of which produces a moment on the sear that is a function of temperature while others, a plurality of captive springs, produce restoring forces that are inversely proportional to acceleration as detected by an acceleration sensor. When the captive springs are sufficiently relaxed by the acceleration sensor, due to an increased acceleration, to allow the sear to rotate, the cocked firing pin is released, the booster is activated and ignition occurs.

28 Claims, 3 Drawing Sheets

TEMPERATURE-COMPENSATED, ACCELERATION-ACTIVATED IGNITER

The invention described herein may be manufactured, used, and licensed by or for the Government for governmental purposes without the payment to me of any royalty thereon.

BACKGROUND OF THE INVENTION

1. Field of the Invention

The present invention relates to propellant igniters and, more particularly pertains to a temperature-compensated, acceleration-activated igniter for use as a temporally accurate ignition means for traveling charges, rocket motors, multiple-staged combustion devices, and the like.

2. Description of the Prior Art

The accurate timing of the ignition of energetic materials is a critical consideration in many fields. For example, in many applications involving the use of combustible propellants, it is desirable to time ignition of a secondary charge in a safe, controlled fashion when the combustion products will materially contribute to the pressures generated by the main charge. In other applications, ignition events must be accurately controlled so as to occur in a precise time sequence. For instance, there are situations wherein certain ignition events for a gun-launched projectile need to occur after shot departure from the gun tube in order to be accurately timed. Also, the multiple staging of propellants is a well known desirable method of obtaining maximum interior ballistic performance.

Previous means employed by some to accomplish these timing functions included the use of deterrents on propellant grains or control of flame-spreading to inhibit or delay the initiation of combustion. Others have considered both solid and liquid propellants functioning as a "traveling charge". Still others have sought the adoption of available space to create the effect of a larger propellant chamber or to produce a delayed secondary charge. To date, such proposals primarily use or cite the potential adoption of delayed combustion stimulated by chemical means. All of these means, in turn, usually function more rapidly when they are initially hot as opposed to being initially cold. This phenomena is inherent in propellants: in the conventional 120 mm tank gun when firing high performance projectiles, the normal peak breech pressure at 70° F. (21° C.) is approximately 75,000 p.s.i. (517 MPa), while at hot (125° F. or 51.7° C.) and cold (−50° F. or −46° C.) initial temperatures, the peak breech pressure generated is normally 93,000 p.s.i. (641 MPa) and 54,000 p.s.i. (372 MPa), respectively. Because of this initial temperature effect, muzzle velocities of conventionally-propelled systems vary as much as 500 feet/sec. Muzzle velocity differences caused by secondary charges ignited by use of pyrotechnic delays would undoubtedly be more unless corrected.

Those concerned with the use of secondary charges as a means for increasing muzzle velocity recognize the potential dangers inherent in the hot ignition of such secondary charges. For example, the adoption of temperature-accelerated ignition trains for secondary propellant ignition in the vicinity of peak pressure could lead to serious system overpressures under hot conditions unless sufficient delay is included. The benefits of such secondary charges would be proportionately less effective if ignition were to be initiated at lower temperatures. Clearly, substantially lower muzzle velocities would be produced for the initially-cold case.

Consequently, for these and other reasons, those skilled in these arts recognize the need for improvements in propellant igniters that permit temporally accurate ignition of energetic materials on-board projectiles. The present invention fulfills this need.

SUMMARY OF THE INVENTION

The general purpose of this invention is to provide an igniter of energetic materials wherein ignition is initiated and accurately timed as a function of temperature in response to the sensing of acceleration of the igniter. To attain this, the present invention contemplates a unique combination of mechanical elements that introduces an ignition delay which varies with temperature. As one result, in gun launched projectiles, higher muzzle velocities under other than hot-conditioned ammunition temperatures are made possible than would otherwise be achieved.

More specifically, the present invention contemplates the use of an igniter having a primer or booster for igniting the propulsive charge. The booster, in turn, is ignited by a firing pin accelerated down its path after being released by a rotary sear. Rotation of the sear is controlled by a plurality of springs. One spring is temperature sensitive and is used to apply a force to the sear that results in a moment on the sear that varies with temperature. A plurality of other springs are employed to provide a moment that varies in accordance with the motion of an acceleration-sensing mass. These elements cooperate such that the resultant moment applied to the rotary sear changes as higher projectile acceleration levels are achieved. Eventually, the sear will disengage itself from the firing pin, resulting in actuation of the booster and ignition of the propellant. According to one aspect of the invention, the spring parameters are chosen such that rotation of the rotary sear can be initiated at lower values of axial acceleration as a function of initial temperature.

It is, therefore, an object of the present invention to provide a temperature-compensated igniter.

Another object is the provision of an acceleration-activated igniter.

A further object of the invention is to provide a mechanically-operated igniter wherein ignition can be initiated at lower values of axial acceleration as a function of temperature.

Still another object of the invention is to achieve higher muzzle velocities of a projectile under other than hot-conditioned ammunition temperatures than would otherwise be possible.

Yet another object is to provide an igniter with positive safety features to prevent premature functioning.

A still further object of the present invention is to provide a sabot-mounted device wherein the bulkhead does not require penetration for propellant-combustion initiation of a delay element.

These and other features of the invention will be more fully understood by reference to the following drawings and detailed description of the preferred embodiments.

DETAILED DESCRIPTION OF THE PREFERRED EMBODIMENTS

Figure 1:
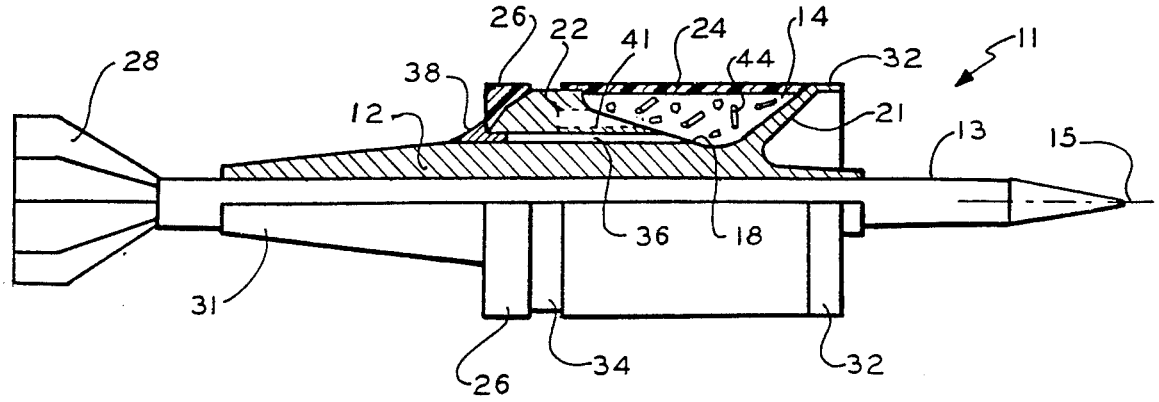
FIG. 1 is a side elevation partly in cross section of a saboted projectile containing the present invention.
Figure 2:
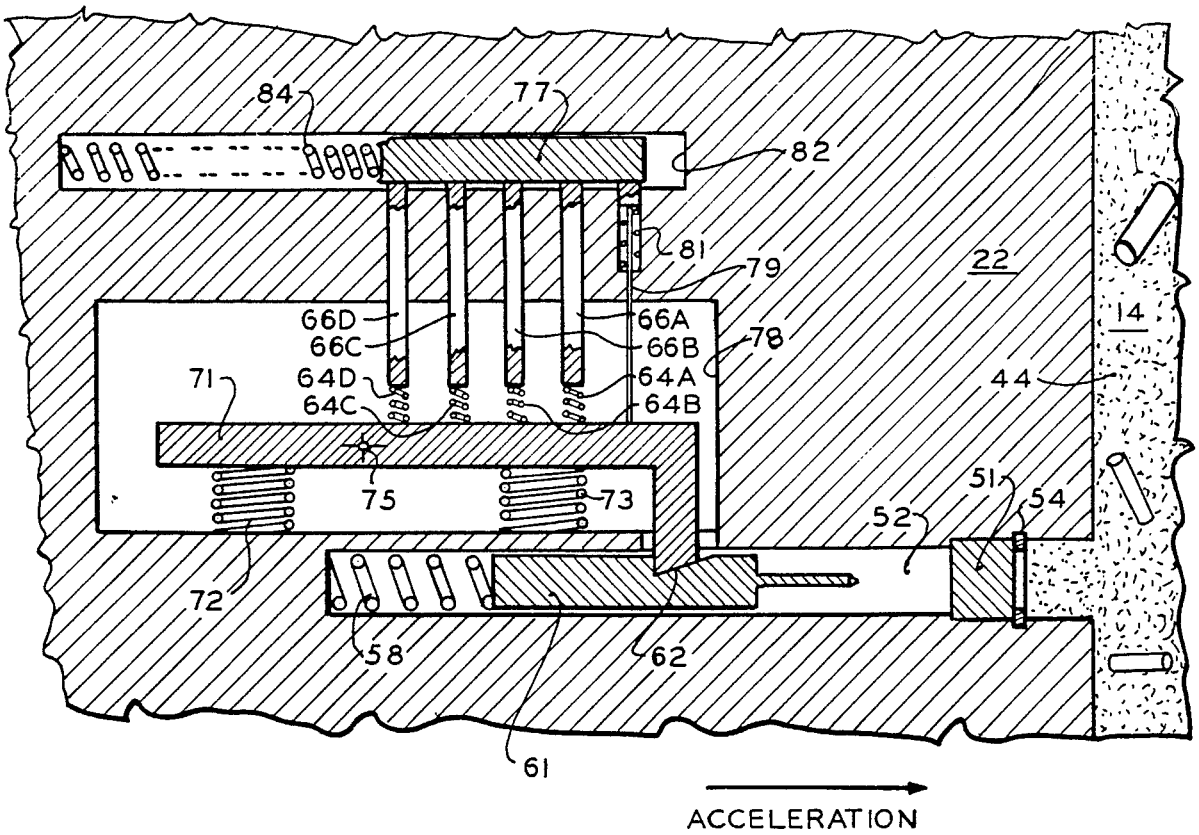
FIG. 2 is a schematic elevation in section of a preferred embodiment.
Figure 3:
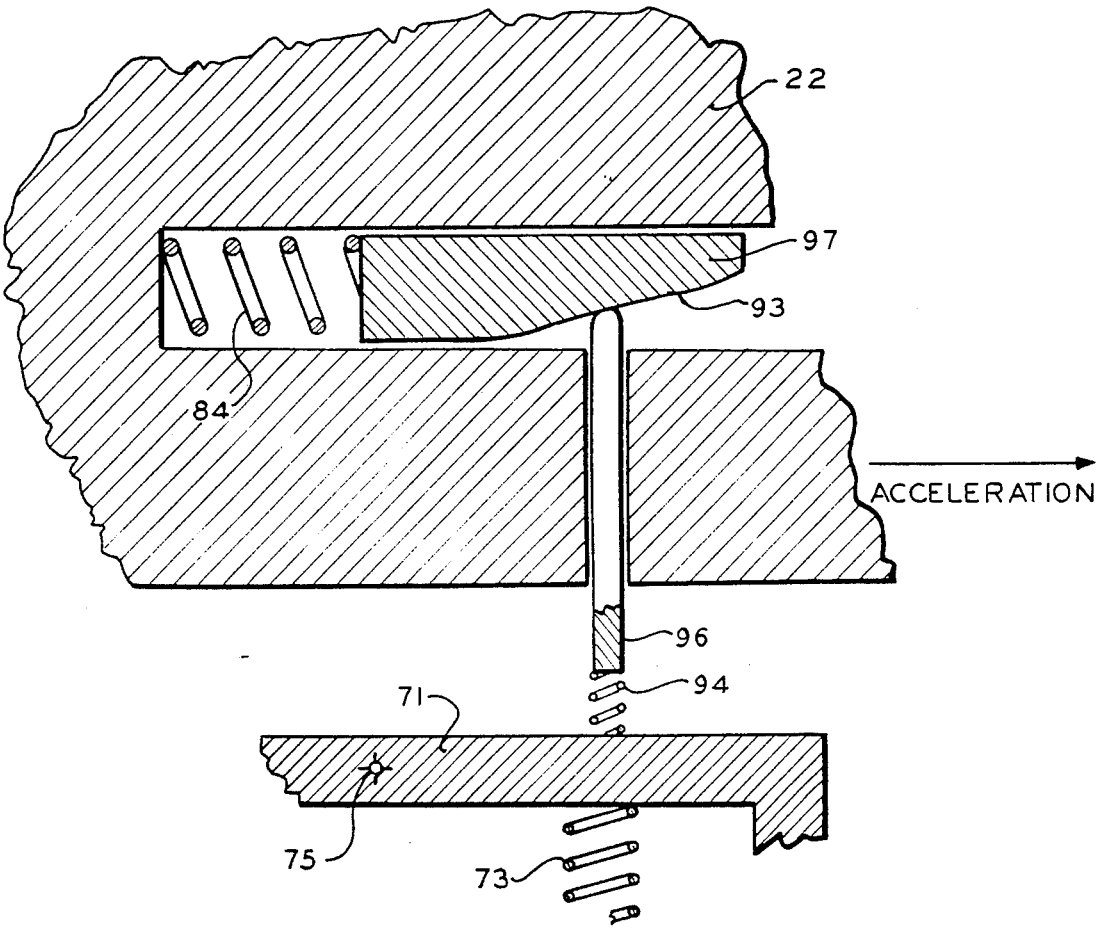
FIG. 3 is a schematic sectional view similar to FIG. 2 showing details of an alternate embodiment.

Referring now to the drawings wherein like reference characters represent like parts throughout the several views, there is shown in FIG. 1 a saboted projectile 11 having a secondary propellant means to increase the muzzle velocity thereof. A projectile similar to projectile 11 is disclosed by Bruce P. Burns and Richard D. Kirkendall in copending U.S. patent application Ser. No. 07/376,090, filed July 3, 1989, entitled "Solid Propellant-Carrying Sabot", Docket No. BRL-88-2, incorporated herein by reference. In general, the FIG. 1 saboted projectile includes a kinetic energy sub-projectile 13 on which is fixed a double-ramp sabot 12 having a toroidal-shaped cavity 14 symmetrically disposed about the longitudinal axis 15 of the projectile 11. Cavity 14 is bounded by the forward ramp 18, the rear surface of a forward scoop 21, the forward surface of a bulkhead 22 and the inside surface of a cylindrical, self-sealing container 24. The rear surface of the bulkhead 22 carries an obturator 26. The rear portion of sub-projectile 13 has stabilizing fins 28. The rear portion of sabot 12 has a rear ramp 31 that is separated from the forward ramp 18 by the bulkhead 22. The forward scoop 21 has a generally frustroconical shape that has a surface extending transverse to axis 15 and terminates in a bore-riding surface 32. Bulkhead 22 also extends transverse to axis 15 and has a bore-riding surface 34. A through-hole 36 extends through bulkhead 22 from the cavity 14 to the rear ramp 31. A solid blow-out plug 38 is housed in the rear opening of through-hole 36. An igniter 41 is mounted in bulkhead 22 adjacent cavity 14. The igniter 41, shown in detail in FIGS. 2 and 3, is only outlined in FIG. 1 to illustrate one possible location. As will become clear below, the igniter 41 may be generally located in the forward portion of bulkhead 22 or the rearmost portion of the forward ramp 18. The igniter 41 is to be disposed so as to be capable of igniting a secondary propellant 44 contained in cavity 14.

The operation of the FIG. 1 projectile 11 is as follows: Upon ignition of a conventional main charge (not shown), e.g. in the breech of a gun, the projectile 11 is thrust forward, causing the obturator 26 to be deformed by the interference fit between it and the inside surface of a gun tube (not shown) forming the primary seal. Prior to effecting the primary seal, ignition of the secondary propellant 44, located within the cavity 14, is prevented by the self-sealing container 24. The plug 38 is held in place by the unbalance of forces caused by the action of the propellant-generated pressure from the main charge acting on the flanged head on the rear of plug 38. The unignited propellant 44 accelerates with the sabot 12, confined in the cavity 14. The igniter 41, as will be described below in detail, will eventually be actuated to ignite propellant 44 at some appropriate time in the ballistic cycle. While the pressure within the cavity 14 rises, it will reach a magnitude wherein the force applied to the front of the plug 38 is greater than that generated by the main charge, and cause the plug 38 to be expelled to the rear, opening the through-hole 36 to the passage of gas or combusting propellant 44 or both, preventing the projectile 11 from failing due to run-away combustion in the cavity 14.

Now with particular reference to FIG. 2, the igniter 41, mounted in bulkhead 22, is shown to have a primer chain or booster 51 held by a locking ring 54 in the forward end of a channel 52 that opens to the cavity 14. Housed in the rear section of channel 52 is a coil spring 58 that engages a slidable firing pin 61 having a notch 62.

In the position shown in FIG. 2, the spring 58 is in compression, held there by the firing pin 61 that in turn is cocked by a rotary sear 71 that engages notch 62. The booster 51 may be a percussion-initiated device or an electrically-initiated device, both of which are familiar to those skilled in these arts. Booster 51 will be activated by the force of the firing pin 61 when it is thrust forward by spring 58 after being released by sear 71 in a manner to be described below.

The sear 71 may be housed in a chamber 78 so as to rotate in the plane of FIG. 2 about the axis 75. The rotary sear 71 is controlled by springs 72, 73 and 64A–64D, which are all in compression, and a rigid slidable bar 79 that is forced upwardly by its captive spring 81. The spring 72 provides a force that is temperature sensitive, and hence provides a moment that varies with temperature. Spring 73 exerts a constant moment. The spring 72 may be made from conventional bi-metallic elements or other suitable materials known to those skilled in these arts. The combination of springs 64A–64D (although four are shown, any reasonable number may be employed) provide a moment that varies in accordance with the motion of an acceleration-sensing mass 77. Mass 77 is slidably housed in a bore 82 that also houses a calibrated spring 84. A plurality of slidable control rods 66A–66D have one end slidably forced against a surface of the acceleration-sensing mass 77 by springs 64A–64D, respectively. The initial motion of the acceleration-sensing mass 77 against the calibrated spring 84 releases the rigid bar 79, unlocking the rotary sear 71 to permit its rotation about axis 75 in accordance with the conservation of angular momentum. The rigid bar 79, which is rapidly displaced upwardly by its captive spring 81, serves as a safety. The rigid bar 79 should be located with respect to the forward end of mass 77 such that some predetermined acceleration force would be necessary to release the safety. For example, the rigid bar 79 could easily be located so that acceleration values in the neighborhood of 10,000 to 20,000 gs would be required for release in the case of kinetic energy projectiles launched from tank main armament systems.

As the acceleration-sensing mass 77 retreats to compress its calibrated spring 84, control rods 66A–66D are sequentially free to move, relaxing the compressive force in their respective springs 64A–64D. As a consequence of this action, the moment applied to the rotary sear 71 changes as higher projectile-acceleration levels are achieved as a consequence of the build-up of propelling charge pressure emanating from the main charge. When the moment applied by spring 73 exceeds the moment applied by the temperature-sensitive spring 72 and the still partially-engaged plurality of springs 64A–64D, the rotary sear 71 begins to rotate counterclockwise to disengage itself from the firing pin 61. The moment applied by the temperature-sensitive spring 72 is larger when it is hot than when it is cool or cold. By appropriate sizing of the moment-generating spring and lever arm parameters, it is clear that springs 72, 73 and 64A–64D can be selected so that rotation of the rotary sear 71 can be initiated at lower values of axial acceleration as a function of temperature, thereby achieving the desired action.

An alternate means for controlling the rotary motion of the rotary sear 71 in response to acceleration is by the use of one (or more) control rods with an initially compressed control spring that is relaxed as the acceleration sensing mass retreats. This approach, which is schematically depicted in FIG. 3, is controlled by a specifically defined raceway 93 or machined slot or surface on the acceleration-sensing mass 97 that dictates the motion of the control rod 96 and, therefore, the degree of confinement of the control spring 94. Although not shown, the adoption of means to reduce the friction at the juncture between the control rod 96 and the acceleration-sensing mass 97, such as the introduction of a wheel or polished or plated surfaces, will be apparent to those skilled in these arts. The rigid bar 79, which serves as a safety feature, is also not shown for convenience.

Figure 5A:
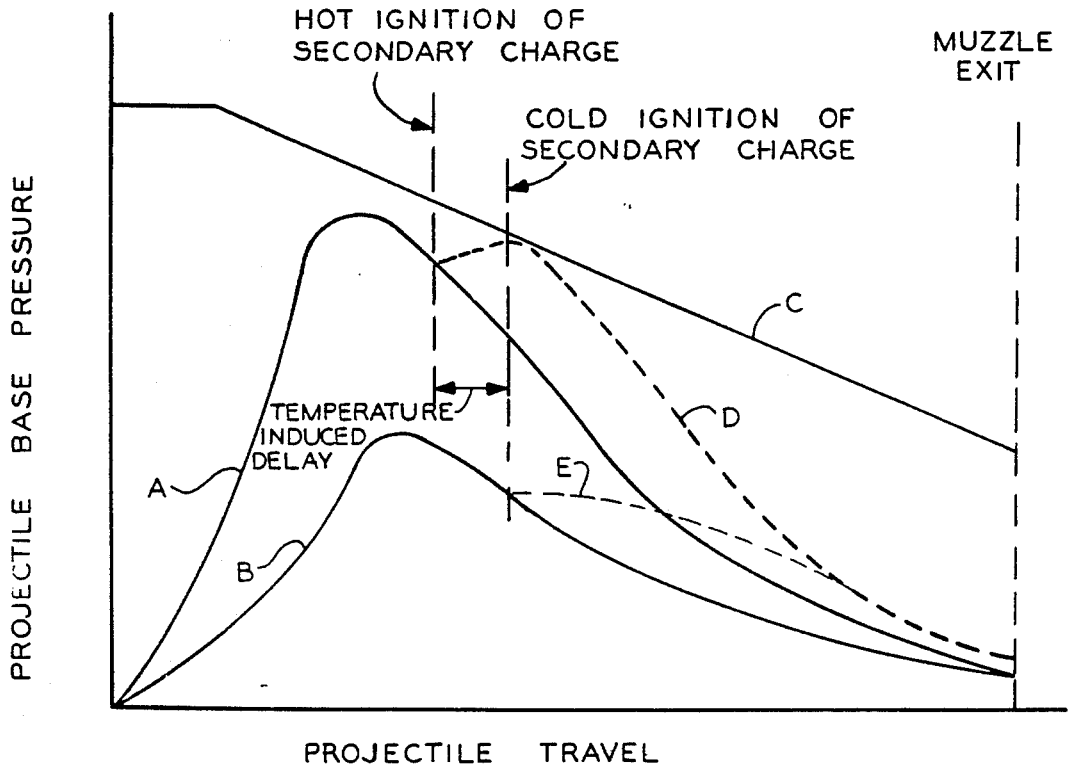
FIGS. 5A and 5B are graphs of pressure curves useful in understanding the present invention.
Figure 5B:
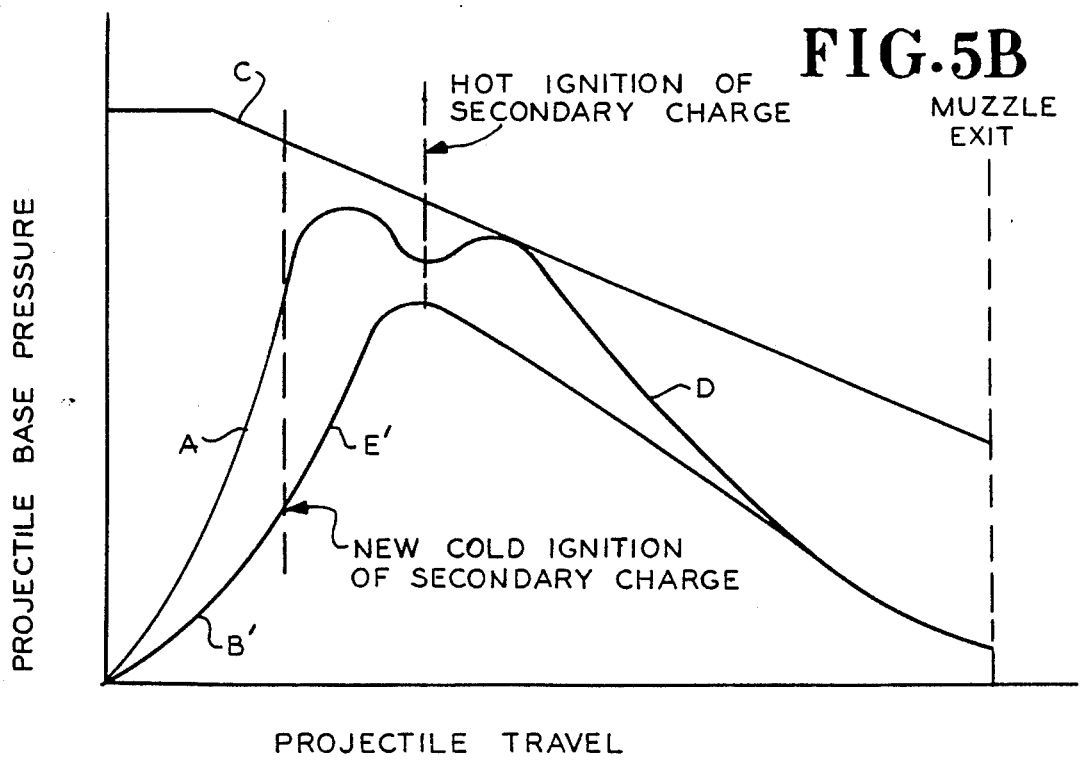

As described earlier, the primary benefits of having the secondary charge 44 is to increase the muzzle velocity of the sub-projectile 13. Obviously, the adoption of a temperature-accelerated igniter for secondary propellant ignition in the vicinity of peak pressure could lead to serious system overpressures under hot conditions unless sufficient ignition delay is included. Also, the initially sought-after benefits of the secondary charge 44 would be proportionately less effective at lower temperatures. These relationships are schematically shown in the graph of FIG. 5A. The solid line curves A and B represent conventional projectile performance without the secondary charge 44. The solid line A represents initially-hot conventional performance while the solid line B represents initially-cold conventional performance. The curve C represents the strength curve of the gun tube. The effect of a secondary charge is depicted with the dashed lines D and E. In order to keep curve D below curve C, ignition of the secondary propellant 44 must be delayed with respect to the peak pressure of curve A. However, when bound to the same delay, the consequence is an even larger difference in muzzle velocity between the initially-hot case, curve D, and the initially-cold case, curve E. The present invention improves this situation as portrayed in FIG. 5B. Here the cold ignition delay has been automatically altered to occur earlier in the cycle, giving rise to higher pressures (curves B′, E′) and, since the higher pressure causes higher axial acceleration of the projectile, higher muzzle velocity results. In the hot case, the same delay occurs automatically, keeping curve D below curve C.

Figure 4:
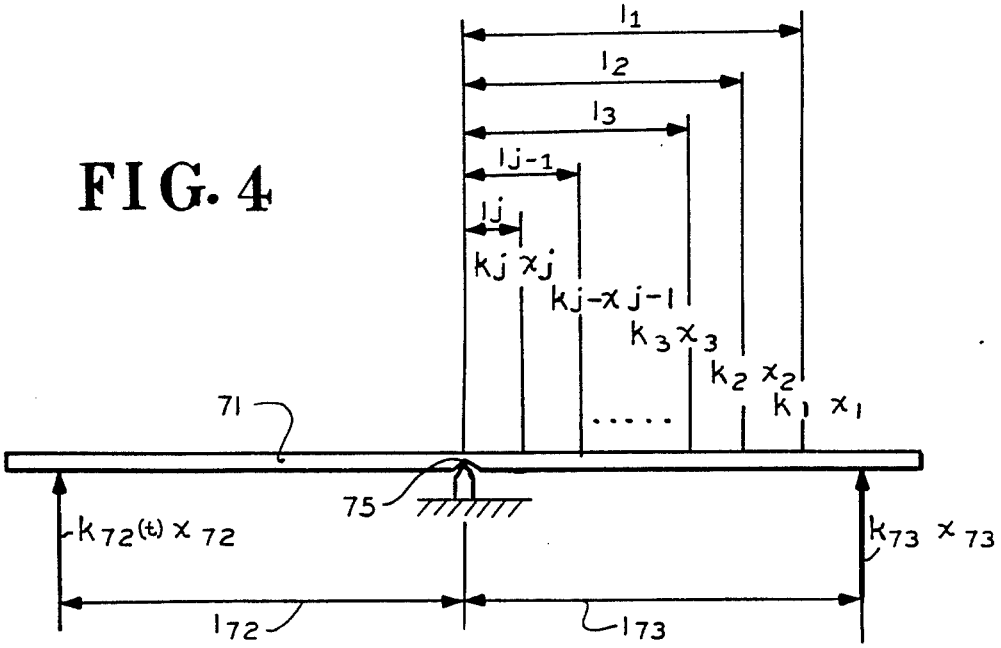
FIG. 4 is a loading diagram useful in forming a mathematical analysis of the preferred embodiments.

A mathematical description of the parameters involved in the operation of the present invention will now be given with respect to FIG. 4. In this analysis, the number of springs 64A–64D are generalized for a plurality of j. The angular momentum equation yields that $$k_{73}x_{73}l_{73}-k_{72}(t)x_{72}l_{72}-\Sigma_j k_j x_j l_j<0 \quad (1)$$

for no motion of the rotary sear 71 to occur. The terms k, x, l, t and j refer, respectively, to the spring constants, the spring compression, the distance from the spring to the rotational center 75 of the rotary sear 71, the temperature, and an index referring to the number of springs 64A–64D influenced by the motion of the acceleration sensing mass 77. Note that $k_{72}$ is taken to be a reasonably strong function of temperature, expressed by $$k_{72}(t)=k_0+Qt, \quad (2)$$

where Q represents the thermal sensitivity of the spring, assumed here, in the interest of simplicity, to be linear and $k_O$ is a constant. If we evaluate the case when an elevated temperature is encountered, we note than when $$k_{73}x_{73}l_{73}-x_{72}l_{72}k_0-Qt(hot)x_{72}l_{72}-\Sigma_p k_p x_p l_p=0, \quad (3)$$

motion of the rotary sear 71 occurs. If the maximum temperature (hence acceleration) was present, then p would equal j, but if this is not the case, then p is less than j. Further, $$k_{73}x_{73}l_{73}-x_{72}l_{72}k_0-Qt(cold)x_{72}l_{72}-\Sigma_m k_m x_m l_m=0, \quad (4)$$

where again due to the action of the acceleration sensing mass 77 reacting to a lower value of peak acceleration, $$m<p. \quad (5)$$

Subtracting equation (4) from (3), we find that $$Q(t(cold)-t(hot))x_{72}l_{72}-k_{m+1}x_{m+1}l_{m+1}-k_{m+2}x_{m+2}l_{m+2}-\ldots-k_p x_p l_p=0, \quad (6)$$

which provides the means for electing the spring parameters influenced by the acceleration-sensing mass 77 as a function of Q. Now if one knows the relationship between initial temperature t and peak gas pressure (or whatever level of pressure one chooses to energize the system as a function of initial temperature), and therefore peak axial acceleration, then the peak displacement of the acceleration-sensing mass 77 is simply $$D_{77}(t)=MA(t)/k_{84} \quad (7)$$

where M is its mass, A(t) is the peak acceleration, and $k_{84}$ is the spring constant of its calibrated spring 84. Small dynamic effects and friction have been ignored. This displacement of the acceleration-sensing mass 77 dictates the number of control rods 64A–64D released, and equations (6) and (7), evaluated across the temperature spectrum, provide the means for selection of the parameters to control the process.

In the alternate approach (FIG. 3), the mathematical description and relationships are simpler. In this approach, where the tapered raceway 93 is used to control the extension of the control spring 94, the axial motion of the acceleration-sensing mass 97 and the contour of the raceway 93 directly control the angular motion of the rotary sear 71. The sear 71 will rotate when $$k_{73}x_{73}l_{73}-k_{72}(t)x_{72}l_{72}-k_r(x_r-e)l_r\Sigma 0 \quad (8)$$

where the precompression of the control spring is $x_r$, where $$x_r>e,$$

and e is a function of the axial displacement of the acceleration-sensing mass 97. Expanding and rearranging, $$k_r e l_r > k_{72}(t) x_{72} l_{72} + k_r x_r l_r - k_{73} x_{73} l_{73}. \quad (9)$$

Since $k_{72}(t)$ increases with temperature, it is clear that the required magnitude of e must be greater to permit rotation, which is consistent with the notion that the peak axial acceleration increases with temperature. Hence, the raceway 93 contour establishes the relationship necessary to control rotation of sear 71 at the desired acceleration as a function of temperature.

Obviously, many modifications and variations of the present invention are possible in the light of the above teachings. For example, the acceleration-sensing mass 77 may be gas pressure biased as opposed to being spring biased as shown. Also, while the invention has been shown in FIG. 1 with respect to its use to ignite a secondary charge in a saboted projectile other uses should be apparent to those skilled in these arts. The igniter may be used to cause the ignition of a rocket motor, base-bleed pyrotechnic materials or ignite a tracer in a reliable fashion. The present igniter may be readily employed as a temperature-sensitive, maximum-g arming device for a warhead, a plurality of warheads, or commercial explosive devices. Those skilled in these arts will readily recognize that the principles of the present invention may be used in a reverse mode to delay the functioning of a warhead or commercial explosive device at impact. Still further, a spin detent may also be employed to provide an additional safety feature when the invention is used with a projectile spun by rifling of a cannon. Also, as mentioned earlier, the igniter may be used further to ignite a staged conventional propelling charge.

It should be understood, of course, that the foregoing disclosure relates to only preferred embodiments of the invention and that numerous modifications or alterations may be made therein without departing from the spirit and scope of the invention as set forth in the appended claims.

What is claimed is:

1. An igniter for energetic material comprising:

a sear having first and second spaced positions;

an ignition means for initiating combustion of the energetic material in response to an actuating force;

firing means for selectively applying the actuating force to the ignition means in response to the sear, and including means controlled by said sear when in the first position for preventing application of said actuating force and for causing application of said actuating force when said sear changes from said first position to said second position; and control means, including means responsive to the temperature and the acceleration of the igniter, coupled to said sear for causing said sear to move from said first position to said second position as a function of the temperature and acceleration of said igniter.

2. The igniter of claim 1 wherein said sear includes a rotating arm having means for selectively engaging said firing means.

3. The igniter of claim 2 wherein said control means includes a temperature sensitive spring engaging said sear to apply a variable force thereto as a function of temperature.

4. The igniter of claim 3 wherein said control means includes force restoring means engaging said sear for applying a variable restoring force to said sear as a function of acceleration of said control means.

5. The igniter of claim 4 wherein the variable restoring force is inversely proportional to said acceleration.

6. The igniter of claim 5 wherein said force restoring means includes at least one captive spring engaging said sear and being controlled by the means for detecting acceleration such that the force exerted by the captive spring on said sear is a function of said acceleration.

7. The igniter of claim 6 wherein said means for detecting accelerations includes a spring biased mass.

8. The igniter of claim 7 wherein the mass includes means for varying the force on said captive spring in response to said accelerations.

9. The igniter of claim 8 wherein the means for varying the force on said captive spring includes a raceway on said mass.

10. The igniter of claim 9 wherein the raceway is non-linear and said force on said captive spring varies non-linearly with said acceleration.

11. The igniter of claim 2 wherein said firing means is a firing pin.

12. The igniter of claim 3 wherein said temperature sensitive spring will permit said sear to move from said first position to said second position at lower values of said acceleration as said temperature becomes lower.

13. The igniter of claim 1 further including a safety means for locking said sear in the first position when the detected acceleration is below a predetermined level of acceleration.

14. The igniter of claim 2 further including a rigid safety bar engaging said sear, and the bar having means for preventing rotation of said sear when the detected acceleration is below a predetermined level of acceleration.

15. An igniter for energetic material comprising:

a sear having an arm rotatable between first and second positions;

a firing pin, having a notch, slidably mounted for movement between a cocked position, wherein the arm engages the notch, and a firing position;

an ignition means for initiating ignition of the energetic material upon contact with the firing pin when in the firing position; and a control means for controlling the position of the arm, said control means including an acceleration sensor, a temperature sensitive spring engaging said arm and force means for applying restoring forces to said arm, said restoring forces being inversely proportional to accelerations sensed by said acceleration sensor.

16. An igniter as in claim 15 wherein said force means includes at least one captive spring engaging said arm and being controlled by the acceleration sensor such that the force exerted by the captive spring on said arm is a function of said acceleration.

17. An igniter as in claim 16 wherein said acceleration sensor includes a spring-biased mass.

18. An igniter as in claim 17 wherein the mass includes means for varying the force on said captive spring in response to sensed accelerations.

19. An igniter as in claim 18 wherein the means for varying the force on said captive spring includes a raceway on said mass.

20. An igniter as in claim 19 wherein the raceway is non-linear and said force on said captive spring vary non-linearly with said acceleration.

21. An igniter as in claim 15 wherein said temperature sensitive spring will permit said arm to move from said first position to said second position at lower values of said acceleration as said temperature becomes lower.

22. An igniter as in claim 15 further including a safety means for preventing said arm from leaving the first position when the detected acceleration is below a predetermined level of acceleration.

23. An igniter as in claim 22 wherein said safety means includes a rigid bar engaging said arm, and the bar having means for preventing rotation of said arm when the sensed acceleration is below a predetermined level of acceleration.

24. A projectile assembly comprising:

a projectile;

a cavity in said projectile carrying an ignitable propellant;

an igniter fixed on the projectile, said igniter including:

a sear having first and second spaced positions;

an ignition means for initiating ignition of the propellant in response to an actuating force;

firing means for selectively applying the actuating force to the ignition means in response to the sear, and including means controlled by said sear when in the first position for preventing application of said actuating force and for causing application of said actuating force when said sear changes from said first position to said second position; and control means, including means for detecting the temperature and acceleration of said projectile, coupled to said sear for causing said sear to move from said first position to said second position as a function of the temperature and acceleration of the control means.

25. The projectile of claim 24 wherein said sear includes a rotating arm having means for selectively engaging said firing means and said control means includes a temperature sensitive spring engaging said sear to apply a variable force thereto as a function of temperature.

26. A projectile in accordance with claim 25 wherein said control means includes force restoring means engaging said sear of applying a variable restoring force to said sear as a function of acceleration of said projectile.

27. A projectile in accordance with claim 26 wherein the variable restoring force is inversely proportional to said acceleration.

28. A projectile in accordance with claim 27 further including a safety means having a rigid safety bar engaging said sear, and the bar having means for preventing rotation of said sear when the detected acceleration is below a predetermined level of acceleration.

* * * * *